US012805691B2

(12) United States Patent
Schultz et al.

(10) Patent No.: US 12,805,691 B2
(45) Date of Patent: Nov. 24, 2026

(54) MULTIPURPOSE CLEANING TOOL

(71) Applicant: FISKARS FINLAND OY AB, Espoo (FI)

(72) Inventors: Heidi Schultz, Espoo (FI); Nicholas Vallo, Milford, NH (US); Samuel Femal, Espoo (FI)

(73) Assignee: FISKARS FINLAND OY AB, Espoo (FI)

( * ) Notice: Subject to any disclaimer, the term of this patent is extended or adjusted under 35 U.S.C. 154(b) by 703 days.

(21) Appl. No.: 18/328,632

(22) Filed: Jun. 2, 2023

(65) Prior Publication Data

US 2024/0398199 A1 Dec. 5, 2024

(51) Int. Cl.
*A47L 13/52* (2006.01)
*A46B 15/00* (2006.01)

(52) U.S. Cl.
CPC ..... *A47L 13/52* (2013.01); *A46B 15/0095* (2013.01); *A46B 2200/30* (2013.01); *A46B 2200/302* (2013.01)

(58) Field of Classification Search
CPC . A47L 13/52; A46B 15/0095; A46B 2200/30; A46B 2200/302
See application file for complete search history.

(56) References Cited

U.S. PATENT DOCUMENTS

D145,887 S * 11/1946 Fox ..... D32/74
2,455,695 A * 12/1948 Monaco ..... A47L 13/52 15/105
3,082,455 A * 3/1963 Evancha ..... A47L 13/52 15/105
D321,631 S * 11/1991 Shaw ..... D30/162
D323,940 S * 2/1992 Murphy ..... D32/74
9,538,895 B1 * 1/2017 Shippen ..... A47L 13/52
D1,079,416 S * 6/2025 Vallo ..... D32/74
D1,080,330 S * 6/2025 Vallo ..... D32/74
2007/0089259 A1 * 4/2007 Jones ..... A46B 15/00 15/257.1
2009/0223007 A1 * 9/2009 Li ..... A47L 13/52 15/171
2021/0289933 A1 * 9/2021 Metzel ..... A47L 13/52

FOREIGN PATENT DOCUMENTS

CA 3 121 983 12/2021

OTHER PUBLICATIONS

Jun. 2, 2025 Office Action issued in Canadian Patent Application No. 3,228,495, pp. 1-4.

* cited by examiner

*Primary Examiner* — Ryan J. Walters
(74) *Attorney, Agent, or Firm* — Nixon & Vanderhye PC

(57) ABSTRACT

The prevent invention relates to a cleaning tool comprising: a body (17) and upstanding side walls (14,16), the body (17) and side walls (14,16) defining a channel to collect debris, the side walls (14,16) comprising retaining means configured to retain a brush in use. The channel comprises a first end (20) axially spaced from a second end (22), where one of the first end (20) and/or second end (22) comprises a different flexibility than the remainder of the channel.

17 Claims, 6 Drawing Sheets

MULTIPURPOSE CLEANING TOOL

The present disclosure relates to a multipurpose tool, in particular, a combination cleaning tool comprising a dustpan and a brush.

BACKGROUND OF THE INVENTION

Combination dustpan and brushes are known in the prior art. Typically, such an arrangement comprises a rigid pan and a brush configured to snap onto a portion of the dustpan, such as the handle thereof. Such arrangements have limited utility and configurability.

The present invention aims to overcome or ameliorate one or more problems with prior art arrangements.

STATEMENT OF INVENTION

According to a first aspect, there is provided: a cleaning tool comprising: a body and upstanding side walls, the body and side walls defining a channel to collect debris, the side walls comprising retaining means configured to retain a brush in use; the channel comprising a first end axially spaced from a second end, where one of the first end and/or second end comprises a different flexibility than the channel.

The first end and/or second end may comprise a different flexibility material. The first end and/or second end may comprise an increased bending resistance. The first end and/or second end may comprise a different cross-sectional area and/or second moment of area.

The first end may comprise a portion of reduced flexibility (i.e. increased rigidity) material to provide a reduced flexibility at the first end. The reduced flexibility material may comprise a rigid polymer. The reduced flexibility material may comprise a rigid polypropylene.

The second end may comprise a reduced bending resistance to provide an increased flexibility at the second end. The reduced bending resistance and/or second moment of area may be provided by a increased height of an upstanding wall and/or a reduced curvature at the second end A height dimension of the upstanding side walls may vary along the axial direction. The height dimension of the upstanding side walls may taper at/toward the first end and/or second end.

The second end may comprise a portion of increased flexibility material to provide an increased flexibility at the second end.

The increased/decreased flexibility material may comprise a strip. The increased/decreased flexibility material may comprise a U-shaped or curved cross-section. The second end may be flexible to allow sealing against a surface. The cleaning tool may comprise a dustpan.

The first end may comprise an increased bending resistance. The first end may comprise a reduced cross-sectional area and/or increased second moment of area. The first end may comprise a reduced cross-sectional area and/or increased second moment of area than said remainder of the channel and/or relative to the second end.

An upstanding side wall portion at the first end may comprise a reduced upstanding height. An upstanding side wall portion at the first end may comprise a reduced upstanding height than a remaining portion of the side walls. The first end may comprise a beak like shape.

The height of the first end side walls may be less than or equal to 60% of the height of the remaining side walls; preferably, less than or equal to 50%; preferably, less than or equal to 40%.

A width dimension of the first end may be less than a width dimension of the second end. The width of the channel may taper (i.e. widen or flare) along the axial length thereof. The width of the channel may converge toward the first end.

The side wall may comprise an overhang or protrusion to provide said retaining means.

A base may extend between the side walls. The base may be concave. The base may be concave in two orthogonal dimensions. The side walls and body may be collectively U-shaped in profile about the axial direction.

The increased and/or reduced flexibility material may be over-moulded the body (i.e. the first and/or second end may be over-moulded). The body may comprise a flange or lip. The flexible material may be mounted on the flange or lip.

The side wall may comprise a grip member. The grip member may be provided at an edge of the side wall. The grip may comprise a protrusion or ridge.

The side walls and/or body may be semi-flexible to allow a user to vary the width of the channel in use. The side walls and/or body may comprise a flexible material. The channel may be open ended. The channel may be semi-tubular. The side walls may be curved. The upstanding walls may be tapered/trapezoidal/wedge shaped.

The dustpan may comprise polypropylene. The polypropylene may be semi-rigid. The dustpan may comprise thermoplastic rubber.

The first end and/or second end may comprise a leading edge facing the axial direction. The first end may be rigid. The first end may provide a shovel or cutting tool.

According to a further aspect, there is provided: a combination cleaning tool comprising: a dustpan having a body and upstanding side walls, the body and side walls defining a semi-tubular channel to collect debris, the channel comprising a first end axially spaced from a second end, where the side walls comprising retaining means; and a brush shaped to engage the retaining means in an interference or friction fit to provide a removable connection therebetween.

The side walls may be tapered, and in order to engage or disengage the retaining means, the brush is moved along the axial direction of the dustpan. The side walls may comprise a complimentary shape to a body portion of the brush.

The brush may comprise a cleaning element. The cleaning element may comprise bristles. The brush may comprise a handle. The brush may comprise an aperture for hanging. The aperture may be provided in the handle.

Any aspect of the invention may be combined with any other aspect of the invention where practicable.

DESCRIPTION

Embodiments of the present invention are described below, by way of example only, with reference to the accompanying drawings.

Figure 1:
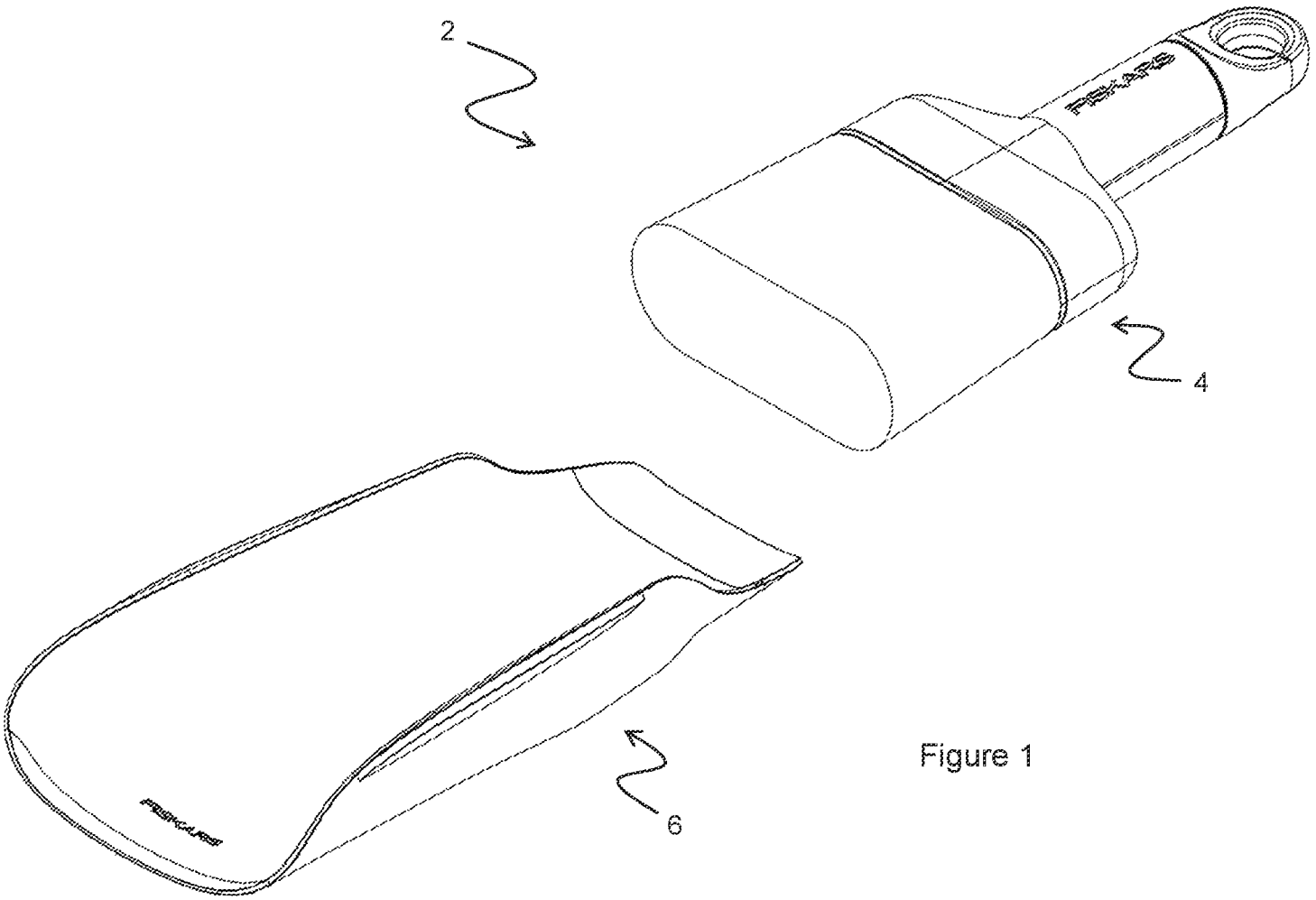
FIG. 1 shows a perspective view of a cleaning tool in a disassembled configuration.
Figure 2:
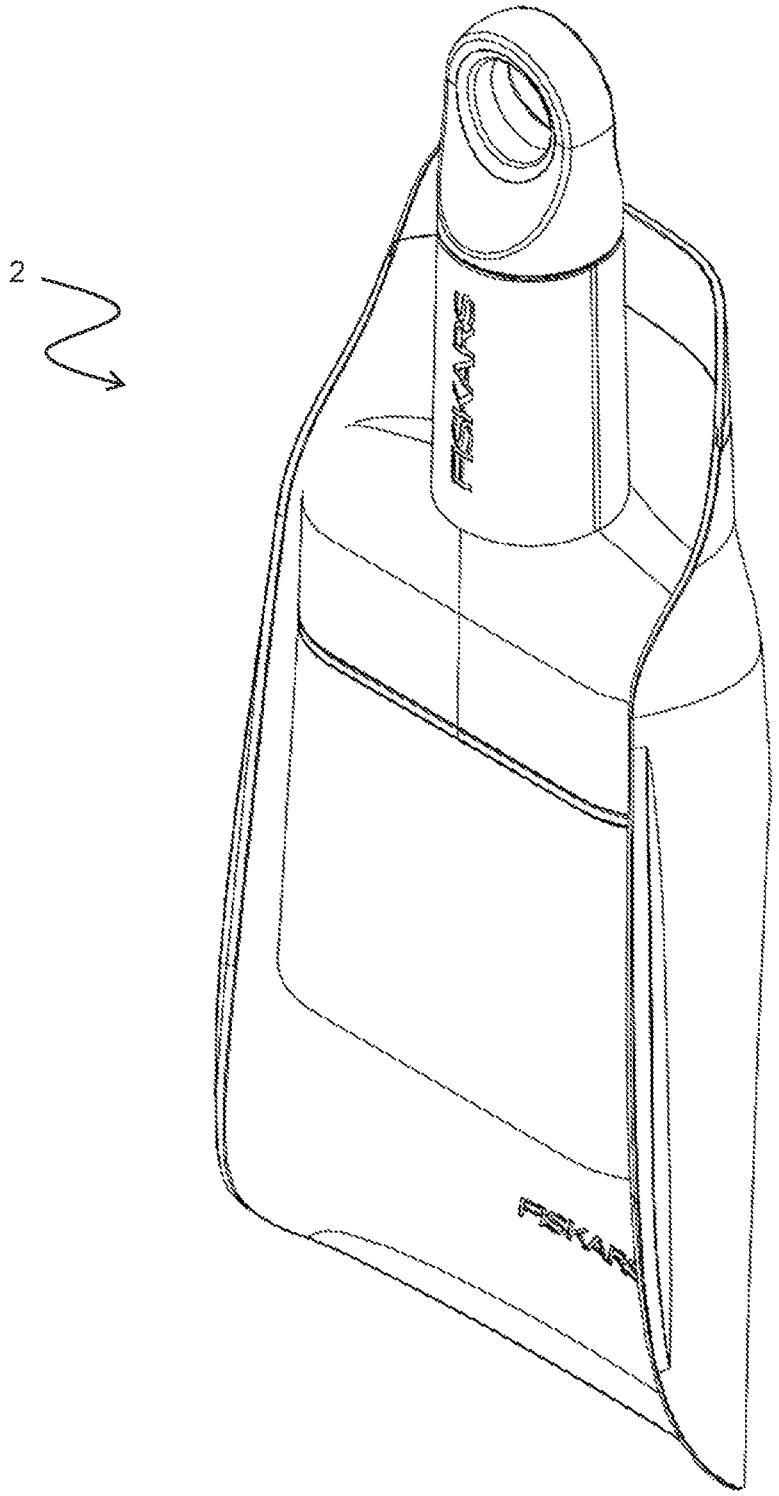
FIG. 2 shows a perspective view of the cleaning tool in an assembled configuration.
Figure 3:
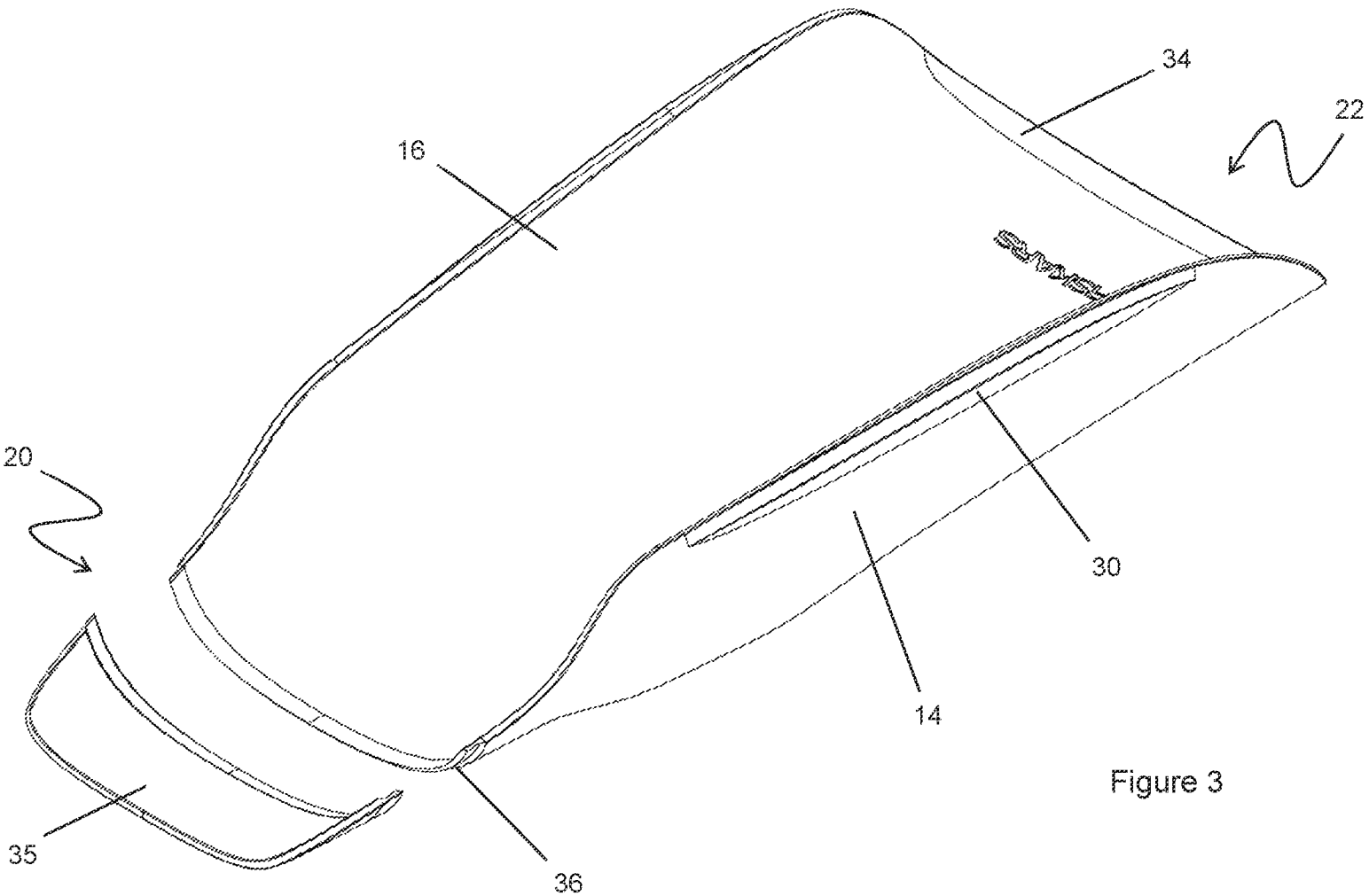
FIG. 3 shows a perspective view of a dustpan/scoop.

A combination cleaning tool 2 is shown in FIG. 1. The tool 2 comprises a brush portion 4 and a dustpan portion 6. As shown in FIG. 2, the brush 4 and the dustpan 6 and configured to engage one another to provide attachment thereof. The brush 4 and the dustpan 6 are connected via an interference or friction fit. The brush 4 and the dustpan 6 are detachably connected in a simple and convenient fashion (i.e. without the use of fasteners etc.).

The dustpan 6 is shown in closer detail in FIGS. 3-7. The dustpan 6 is generally elongate about an axial direction 8. The dustpan 6 comprises a curved or U-shaped cross-section perpendicular along said axial direction 8. The dustpan 6 comprises a semi tubular (i.e. a half tube or half pipe) shape (see FIGS. 6 and 7). The sides 10,12 of the dustpan 6 are delimited by walls 14,16. The walls 14, 16 are curved or otherwise blended to the dustpan 6 to provide the curved shape thereof. The walls 14,16 are upstanding from a central body portion 17. The central body 17 may comprise a curved cross-sectional profile in the axial direction 8. The walls 14,16 and body 17 define a channel extending through the dustpan 6.

Figure 4:
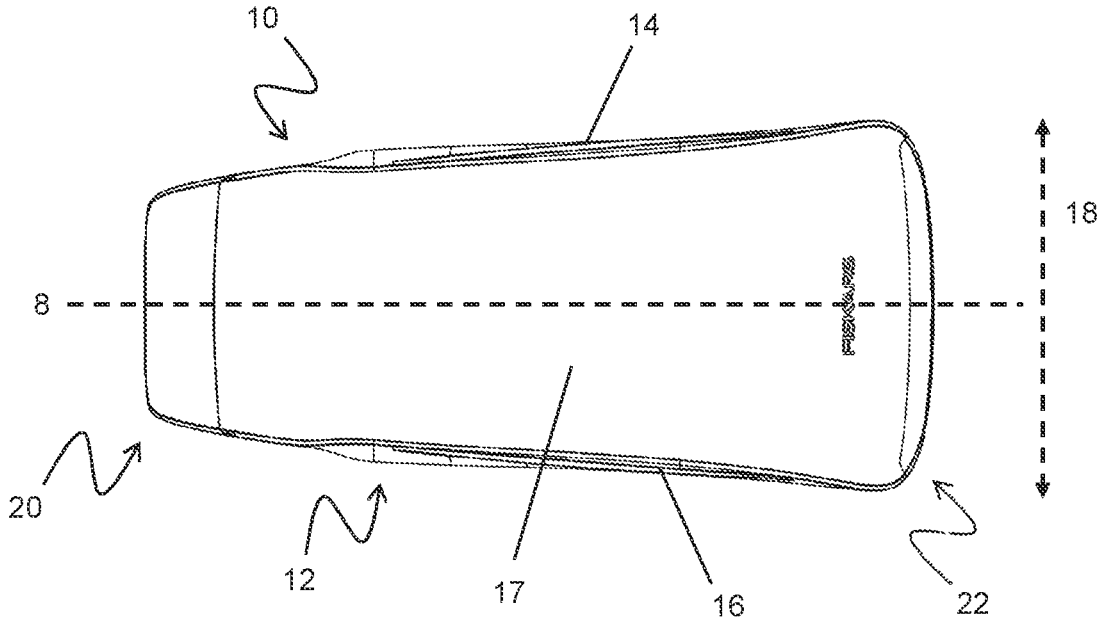
FIG. 4 shows a top-down view of the dustpan/scoop.

As best seen in FIG. 4, the width 18 of the dustpan 6 tapers toward a first end 20 and away a second end 22. The walls 14, 16 are therefore tapered/convergent toward the first end 20. The ends 20,22 are provided at either end of the channel. The channel therefore comprises a tapered shape.

This converging shape provides a space for the brush 4 to engage and be retained therein. The converging shape additionally helps to vary the geometry and being resistance, as will be described later.

Figure 5:
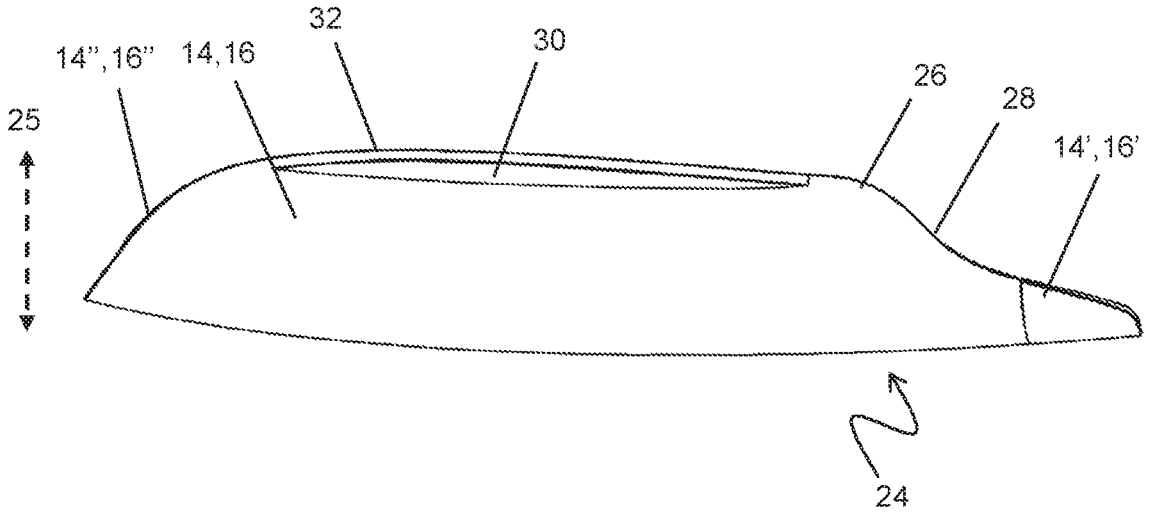
FIG. 5 shows a side view of the dustpan/scoop.
Figure 6:
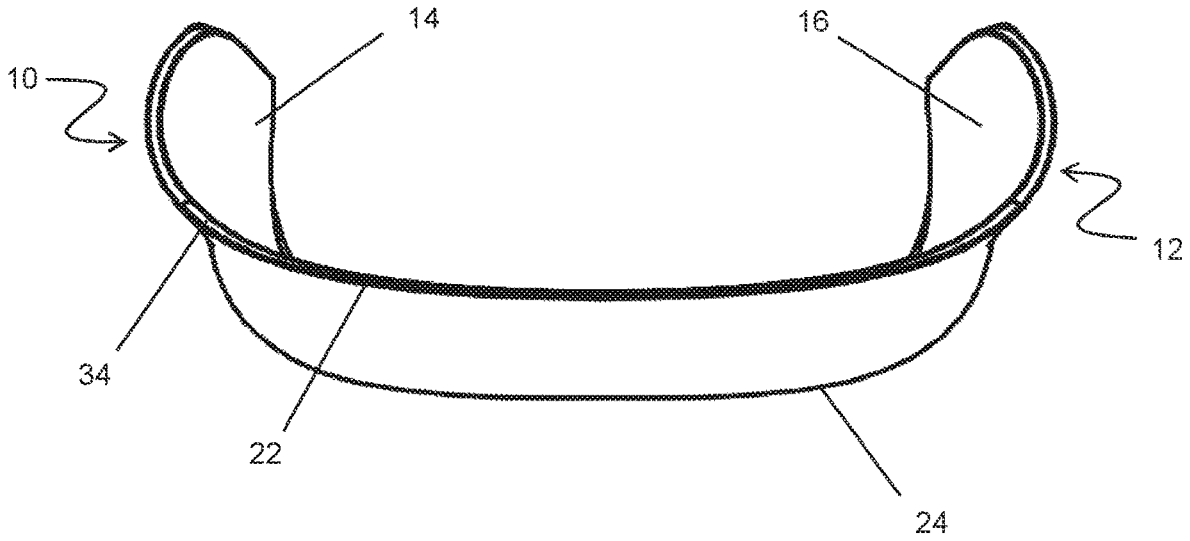
FIG. 6 shows a first end view of the dustpan/scoop.
Figure 7:
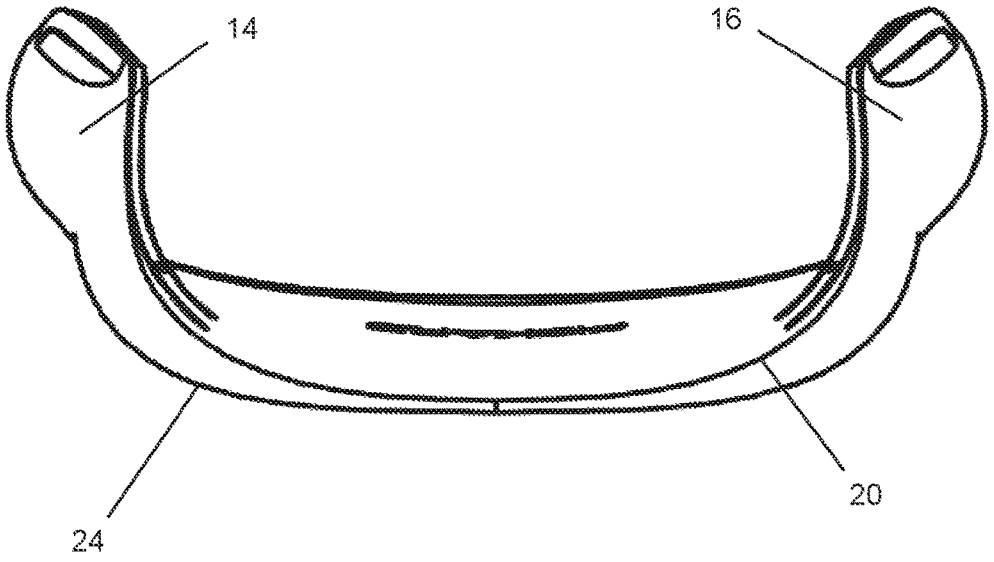
FIG. 7 shows a second end view of the dustpan/scoop.

As best seen in FIG. 5, dustpan 6 comprises a curved lower surface or base 24. The dustpan 6 thus comprises a bowl or tray like shape. The dustpan 6 is curved or concave in 2 dimensions (i.e. along and perpendicular to the axial direction 8). This helps to retain debris therein. The height 25 of the dustpan 6 tapers toward the first end 20. The gradient of the taper varies toward the first end 20. For example, the region of the walls 14,16 the taper is gradual along the axial direction 8. In a second region 26, the taper/gradient is large. In third a region 28, the taper is gradual. The height (i.e. an upstanding dimension) of the end side walls 14',16' is less than that side walls 14,16 in the central portion. T The height of end side walls 14',16 may less than or equal to 60% side walls 14,16; preferably, less than or equal to 50%; preferably, less than or equal to 40%. The first end 20 thus comprises a beak or flange like shape in a side profile.

The height of the upstanding walls 14",16" tapers toward the second end 22. The effective height of the dustpan 6 is therefore reduced at the second end 22.

The dustpan 6 comprises a grip portion 30. The grip 30 comprises a ridge or protrusion. The grip 30 is provided at the edge 32 of the side wall 14,16 (i.e. the grips 30 extend along the length of the edge thereof). The grip 30 comprises an angular/polygonal surface. In other embodiments, the grip 30 may curved/bulbous.

The dustpan 6 comprises a semi-flexible material (i.e. it maintains its own shape, but can be deformed under stress). This allows the user to manipulate the shape of the dustpan 6, for example, to bring the walls 14, 16 toward one another. The dustpan 6 comprises a polymeric material. The polymeric material comprises semi-rigid polypropylene. The semi-rigid polypropylene may comprise thermoplastic rubber to increase flexibility. The curved/bowl shape of the dustpan 6 additionally allows the dustpan 6 to provide a scoop like arrangement (e.g. to scoop up debris or soil).

The second end 22 comprises a flexible portion, area or element 34. The area 34 spans the end/leading edge 20 of the dustpan 6. The area 34 comprises a flexible material. The flexible area comprises a thermoplastic, for example, polypropylene and/or thermoplastic rubber. The area 34 comprises a U-shaped or curved cross-section. In the present embodiment, the flexible area is integral with the body 17. In other embodiments, the flexible material may comprise silicone, rubber or the like. The element 34 may be moulded onto the dustpan 6 (i.e. over moulded thereon).

The effective height of the upstanding walls 14, 16 is significantly reduced at the flexible area 34 (e.g. due the tapering of the height 25). The relatively large width of the area 34 allows easy flexion thereof (as the user can apply a greater bending moment). The extent of the upstanding curve defined the side walls 14",16" is significantly reduced (see FIG. 7). The bending resistance therefore reduced, thus allowing greater flexion thereof. The area 34 can therefore conform to the shape of the surface onto which it is placed (e.g. the ground), thereby allowing debris to more easily enter the dustpan 6.

The first end 20 is more rigid than the second end 22. The first end 20 is narrower than second end 22. This provides a rigid, narrow head, allowing the dustpan 6 to be used to a shovel or separation instrument. For example, the first end 20 may be used to break up clumps of soil. The first end 20 comprises a leading edge extending in the axial direction 8 (i.e. there is no upstanding wall).

The first end 20 comprises an element 35 configured to provide a greater relative rigidity. The element may be over-moulded onto the dustpan 6. The element 35 comprise a relatively greater rigidity or hardness material. For example, the element may comprise an abrasion resistant material. The element 34 comprise a rigid polypropylene.

The element 35 delimits the third region 28. The element 35 thus defines a reduced height portion of the dustpan. However, the walls 14',16' are sufficient in height and curvature to provide enough bending resistance that the element 35 remains rigid. A flange or lip 36 is provided on the dustpan 6 to allow overlap of the dustpan 6 and the element 35. The element 35 is trapezoidal in profile (see FIG. 4). In some embodiments, the first end 20 may be integral with the body 17 and rigidity is provided, for example, by increasing the thickness thereof relative to the body 17.

Both the first end 20 and the second end 22 provide leading faces facing the axial direction 8 (i.e. no end faces are provided at the ends). The leading edges can there be used to scoop up soil/debris, or in the case of the first end 20, be used as a shovel or cutting tool.

Figure 9:
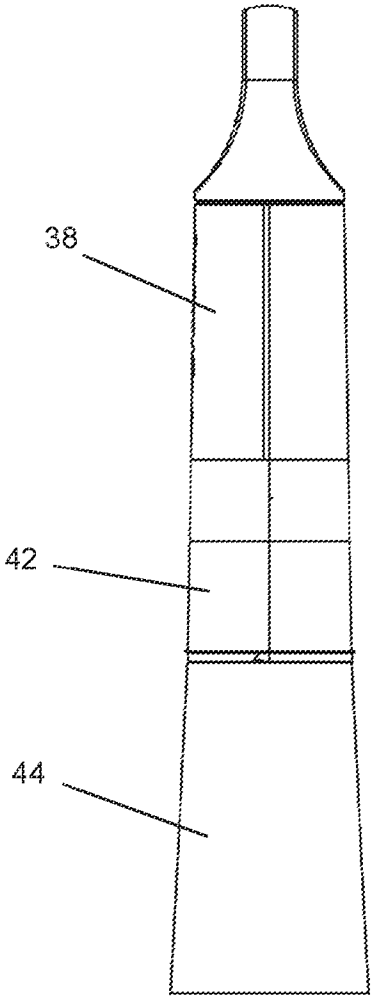
FIG. 9 shows a side view of the brush.
Figure 8:
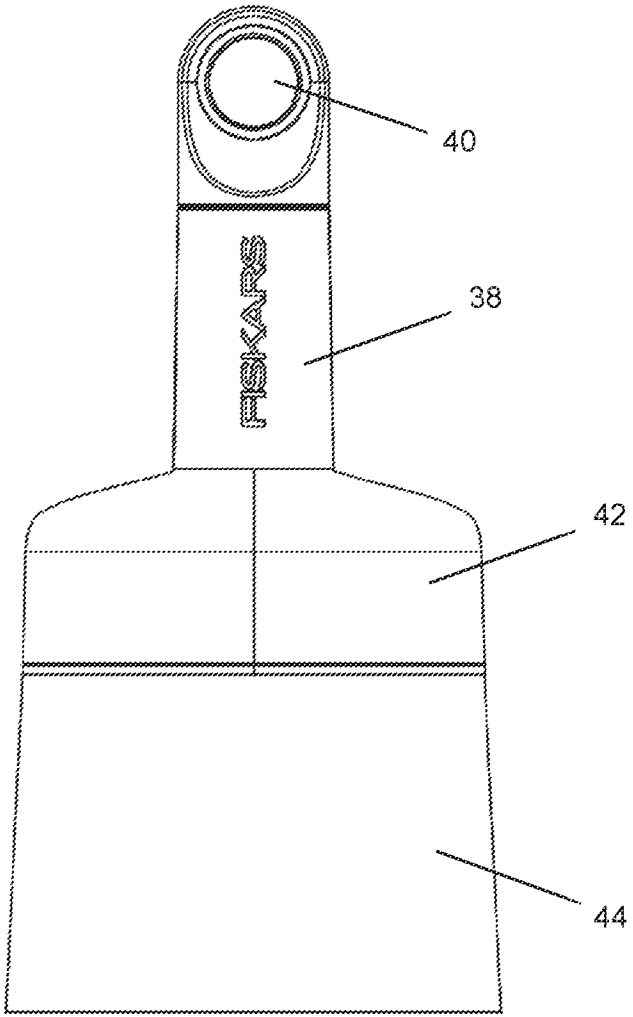
FIG. 8 shows a front view of a brush.

The brush 4 is described with reference to FIGS. 8 and 9. The brush 4 comprise a handle portion 38. The handle 38 is elongate. The handle 38 comprises an aperture 40 therein. The aperture 40 may accommodate a hook or the like to allow the tool 2 to hung therefrom. The brush 4 comprises a body portion 42. The body portion 42 connects the handle 38 to a cleaning element 44. The cleaning element 44 is configured to clean or brush debris. The cleaning element 44 comprises any suitable form, for example, one or more of: bristles; flexible fingers; ridges or nodules; or flexible strips etc.

The body portion 42 is configured to provide a friction/interference/push fit with the dustpan 6. The body portion 42 is correspondingly shaped to the dustpan. The body portion 42 comprises a tapering width (see FIG. 8). The body portion 42 comprises a tapering height (see FIG. 9). The tapering comprises the same gradient as the dustpan 6 at the portion thereof at which the body portion 42 engages.

The edges 32 of the walls 14,16 form a slight overhang, thereby at least partially enclosing/retaining the brush 4. The brush 4 is thereby retained via curvature of the dustpan 6. In other embodiments, the walls 14,16 may comprise flanges, grooves, protrusions or other interlocking features to provide retention of the brush 4.

The dustpan 6 may comprise any suitable shape or configuration. In some embodiments, the dustpan 6 may comprise a rectangular or polygonal cross-section along the axial direction 8. The brush body 42 comprise a similar shape accordingly. However, it can be appreciated that the curved shape allows for easier deformation thereof, without causing stress concentrations etc. The curved shape also allows the user to hold the dustpan 6 in one hand. The dustpan 6 can also be moulded in a single step.

OPERATION OF THE INVENTION

The user can remove from brush 4 from the dustpan 6 by sliding the brush 4 toward the second end 22. The brush 4 moves out of frictional engagement with the walls 14,16 and is released. The user is then free to use the brush 4 and the dustpan independently.

The user may use the first end 20 to dig/move soil and/or break down clumps of soil, for example, during planting or repotting. The user may scoop up soil etc. using the dustpan 6. The user can then release the soil via the second end 22. The user can compress/release the side wall 14,16 to vary the volume of the dustpan 6 and also to control the effective width of the first end 20 and/or second end 22. The user can therefore control the release of the soil from within the scoop by compressing/releasing side walls 14,16.

Once the shovel function is complete, the dustpan 6 can be used similarly to a conventional dustpan 6. The user pushes the second end 22 into the floor/ground, such that the flexible area 34 forms a good contact/seal thereagainst. The user can then use the brush 4 to sweep soil or debris into the dustpan 6.

Once cleaning is complete, the user places the brush 4 into the channel with the handle 38 facing toward the first end 20. The user then slides the brush 4 toward the first end 20 until it engages the walls 14, 16. The user may then hang the tool 2 via the aperture 40. The dustpan 6 is configured such that the diverging walls 14,16 face away from the handle 38, so that when the tool 2 is suspended by the aperture 40, the brush 4 is biased into engagement with the dustpan 6.

The present arrangement may be used in cleaning in a horticultural environment (i.e. gardening), in particular, as the dustpan 6 can be used as both a shovel/scoop and as a conventional dustpan. The present environment provides particular benefit in indoor horticultural environment (e.g. maintenance of house plants), where precise control is soil flow and high degree of debris removal is required.

The variation of the flexibility of the dustpan allows the dustpan to be used as a scoop/shovel and as a dustpan to collect debris. The variation of the flexibility is accomplished in a simple design by variation of the geometry of the dustpan and using simple over moulding techniques.

The invention claimed is:

1. A cleaning tool comprising:

a body and upstanding side walls, the body and side walls defining a channel to collect debris, the side walls comprising retaining means configured to retain a brush in use;

the channel comprising a first end axially spaced from a second end, wherein the first end and the second end comprise a different flexibility than the channel, wherein the first end comprises a portion of reduced flexibility material to provide a reduced flexibility at the first end, wherein the side wall comprises a grip member extending along the edge thereof and the side walls are semi-flexible to allow a user to vary the width of the channel in use and wherein the grip member is polygonal and curved.

2. A cleaning tool according to claim 1, wherein the reduced flexibility material comprises a rigid polymer.

3. A cleaning tool according to claim 1, wherein the second end comprises a reduced bending resistance to provide an increased flexibility at the second end.

4. A cleaning tool according to claim 1, wherein a height dimension of the upstanding side walls varies along the axial direction.

5. A cleaning tool according to claim 4, wherein the height dimension of the upstanding side walls tapers at the first end and/or the second end.

6. A cleaning tool according to claim 1, wherein a width dimension of the first end is less than a width dimension of the second end.

7. A cleaning tool according to claim 6, wherein the width of the channel converges toward the first end.

8. A cleaning tool according to claim 1, wherein the width of the channel tapers along the axial length thereof.

9. A cleaning tool according to claim 1, wherein the side wall comprises an overhang or protrusion to provide said retaining means.

10. A cleaning tool according to claim 1, comprising a base extending between the side walls, the base being concave in two orthogonal dimensions.

11. A cleaning tool according to claim 1, wherein the side walls and body are collectively U-shaped in profile about the axial direction.

12. A cleaning tool according to claim 1, wherein the reduced flexibility material is over-moulded onto the body.

13. A cleaning tool according to claim 1, wherein the side walls are semi-flexible to allow a user to vary the width of the channel in use.

14. A cleaning tool according to claim 1, wherein the first end and/or the second end comprises a leading edge facing the axial direction.

15. A cleaning tool according to claim 1, where the first end is rigid to act as a shovel or cutting tool.

16. A combination cleaning tool comprising:

a dustpan having a body and upstanding side walls, the body and side walls defining a semi-tubular channel to collect debris, the channel comprising a first end axially spaced from a second end, the side walls comprising retaining means; and a brush shaped to engage the retaining means in an interference or friction fit to provide a removable connection therebetween, wherein the side wall comprises a grip member extending along the edge thereof and the side walls are semi-flexible to allow a user to vary the width of the channel in use, wherein the grip member is polygonal and curved.

17. A combination cleaning tool according to claim 16, wherein the side walls are tapered, and in order to engage or disengage the retaining means, the brush is moved along the axial direction of the dustpan.

* * * * *